US006658778B2

(12) United States Patent
Roy

(10) Patent No.: US 6,658,778 B2
(45) Date of Patent: Dec. 9, 2003

(54) PICTURE FRAME JOINT AND METHOD OF ASSEMBLING SAME

(75) Inventor: Armand E. Roy, Attleboro, MA (US)

(73) Assignee: Craft, Inc., S. Attleboro, MA (US)

( * ) Notice: Subject to any disclaimer, the term of this patent is extended or adjusted under 35 U.S.C. 154(b) by 0 days.

(21) Appl. No.: 10/248,764

(22) Filed: Feb. 14, 2003

(65) Prior Publication Data

US 2003/0145502 A1 Aug. 7, 2003

Related U.S. Application Data

(63) Continuation-in-part of application No. 10/054,050, filed on Jan. 22, 2002.

(60) Provisional application No. 60/318,583, filed on Sep. 11, 2001.

(51) Int. Cl.[7] ..... A47G 1/10

(52) U.S. Cl. ..... 40/782

(58) Field of Search ..... 40/782, 783, 784, 40/785; 403/401, 402, 409.1

(56) References Cited

U.S. PATENT DOCUMENTS 3,528,691 A * 9/1970 Matich ..... 403/409.1
3,899,858 A * 8/1975 Zanker ..... 403/409.1
4,365,907 A * 12/1982 Berry ..... 403/12
4,862,612 A * 9/1989 Sugihara et al. ..... 40/782
4,892,435 A * 1/1990 Anderson ..... 403/409.1
4,974,352 A * 12/1990 Shwu-Jen ..... 40/783
5,464,299 A * 11/1995 Scharer et al. ..... 403/409.1
5,624,201 A * 4/1997 Offenbroich ..... 403/409.1
5,785,461 A * 7/1998 Lambert ..... 403/409.1

* cited by examiner

*Primary Examiner*—Gary Hoge
(74) *Attorney, Agent, or Firm*—Barlow, Josephs & Holmes, Ltd.

(57) ABSTRACT

A structural joint for connecting picture frames members together includes a base plate slidably residing in a channel of a first picture frame member and includes a ramped surface. A wedge plate slidably resides between the base plate and a top bearing surface of the frame and includes its own ramped surface where the ramped surface of the wedge plate is arranged in an opposite direction to the ramped surface of the base plate. The wedge plate is moved toward the base plate to cause the ramp of the base plate to bear on the ramp of the wedge plate to urge the base plate apart from the wedge plate creating a friction fit within the channel of the picture frame member thus securing the base plate relative to the frame. A second wedge plate is also provided for engagement with a second ramp on the base plate to further secure a second picture frame member to the first picture frame member, such as at a ninety degree angle relative thereto. The wedge plates are connected to the base plate to ensure alignment of the ramped surfaces and to facilitate installation.

18 Claims, 15 Drawing Sheets

PICTURE FRAME JOINT AND METHOD OF ASSEMBLING SAME

CROSS REFERENCE TO RELATED APPLICATIONS

This application claims the benefit of U.S. Provisional Patent Application Serial No. 60/318,583, filed Sep. 11, 2001 and is a continuation-in-part of Ser. No. 10/054,050, filed Jan. 22, 2002.

BACKGROUND OF INVENTION

The present invention relates generally to hardware use for picture frames. More specifically, the present invention relates to the hardware used to connect various picture frame components together, such as "channel" or "profile" picture frame components.

In the industry, these known picture frame components are typically manufactured of aluminum but may be of other materials, such as molded plastic. Typically, these frames include a total of four members with ends mitered at 45 degrees so that they may neatly mate with one another to form the frame. There is a need in the art to secure the mitered ends together to maintain the frame in its desired shape.

Also in the industry, wood frames are also employed. These frames must be nailed, glued or stapled together. However, with metal frames, such as the above "channel" frames made of aluminum with a channel therein, some type of joint connector must be employed to secured the ends to each other. Known picture frame joints in the prior art typically include an L-shaped plate with two short threaded fasteners through female threaded apertures on each of the two legs of the L-shaped plate. The bottom of the screw members communicate with a thrust plate which is, essentially, the same size and dimension of the main plate but does not have any threaded apertures. These two members are mated together and inserted into the frame to form a "set screw" configuration. As the screws are threaded through the female apertures, the bottom of the screws emanate further below the main member to cause the main member and the thrust plate to be urged further away from each other. Since these two members are residing within a channel in the aluminum frame, the joint is secured therein in clamping fashion. Of course, a second frame member is provided 90 degrees to the one provided to, in turn, form the desired square or rectangular configuration. This prior art construction requires the formation of the threaded bores as well as the tapping of the screws for shipping. However, it is common for these screw members to back out of their respective bores during transit requiring replacement and further handling for installation.

In view of the foregoing, there is a demand for a picture frame joint to be very easy and inexpensive to mass produce. There is a further need for a picture frame joint to be simple and easy to install and remove. There is a demand for a picture frame joint that has few parts that cannot be lost during transit of the picture frame when in an assembled or partially assembled form. There is also a demand for a picture frame joint that does not use expensive tapped holes or other threaded parts.

SUMMARY OF INVENTION

The present invention preserves the advantages of prior art picture frame joints and related hardware. In addition, it provides new advantages not found in currently available joint constructions and overcomes many disadvantages of such currently available devices and assemblies.

The invention is generally directed to a novel structural joint that has particular application in the connection of picture frame members together. More specifically, the present invention is well-suited for connection of picture frame members together that are of the channel type which are either extruded, machined or molded with an elongated channel running longitudinally therethrough.

The picture frame joint of the present invention includes a base plate slidably residing in a channel of a first picture frame member and includes a ramped surface. A wedge plate slidably resides between the base plate and a top bearing surface of the frame and includes its own ramped surface where the ramped surface of the wedge plate is arranged in an opposite direction to the ramped surface of the base plate. The wedge plate is moved toward the base plate to cause the ramp of the base plate to bear on the ramp of the wedge plate to urge the base plate apart from the wedge plate creating a friction fit within the channel of the picture frame member thus securing the base plate relative to the frame. A second wedge plate is also provided for engagement with a second ramp on the base plate to further secure a second picture frame member to the first picture frame member, such as at a ninety degree angle relative thereto.

It is therefore an object of the present invention to provide a picture frame joint that replaces the well known picture frame joint of the "set screw" type. A further object of the present invention is to provide a picture frame joint that is inexpensive and easy to manufacture in high volume. Another object of the invention is to provide a picture frame joint construction that does not use expensive tapped holes and threaded set screws. A further object of the present invention is to provide a picture frame joint that is not susceptible to lost parts during transit of the frame when in an assembled or partially assembled form. Yet another object of the present invention is to provide a picture frame joint that requires less handling to reduce the labor associated with installing picture frames joints and assembling picture frames.

BRIEF DESCRIPTION OF DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION

Figure 1:
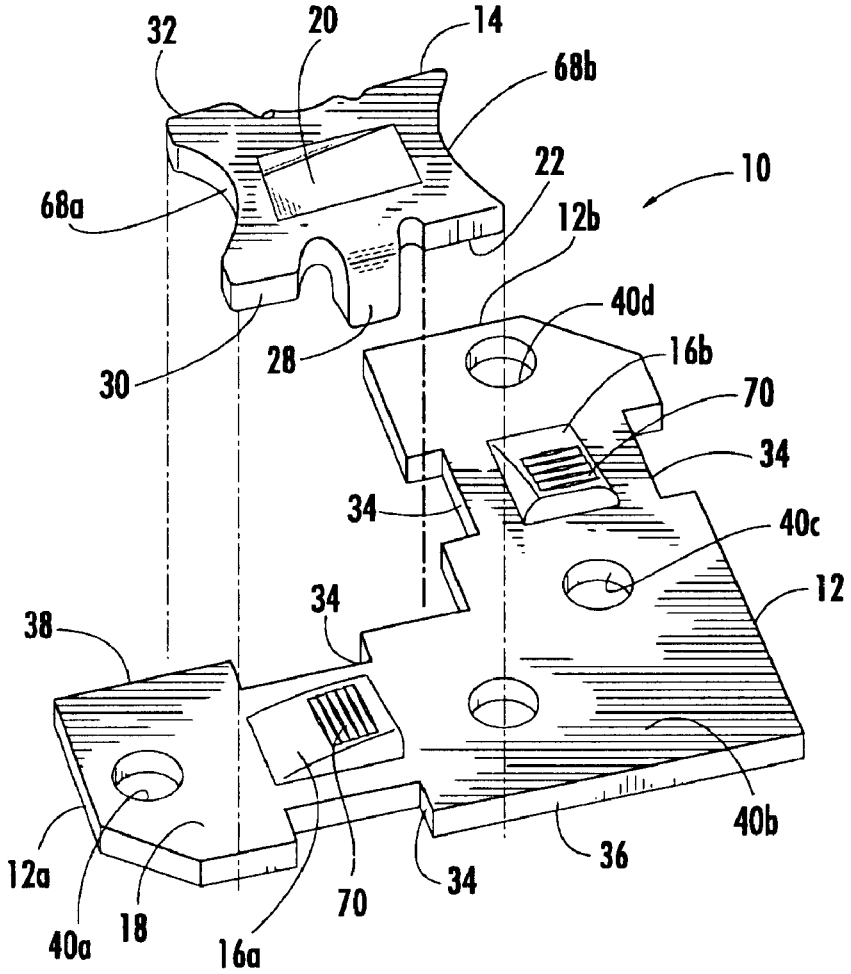
FIG. 1 is a top exploded perspective view of the picture frame joint of the present invention.
Figure 2:
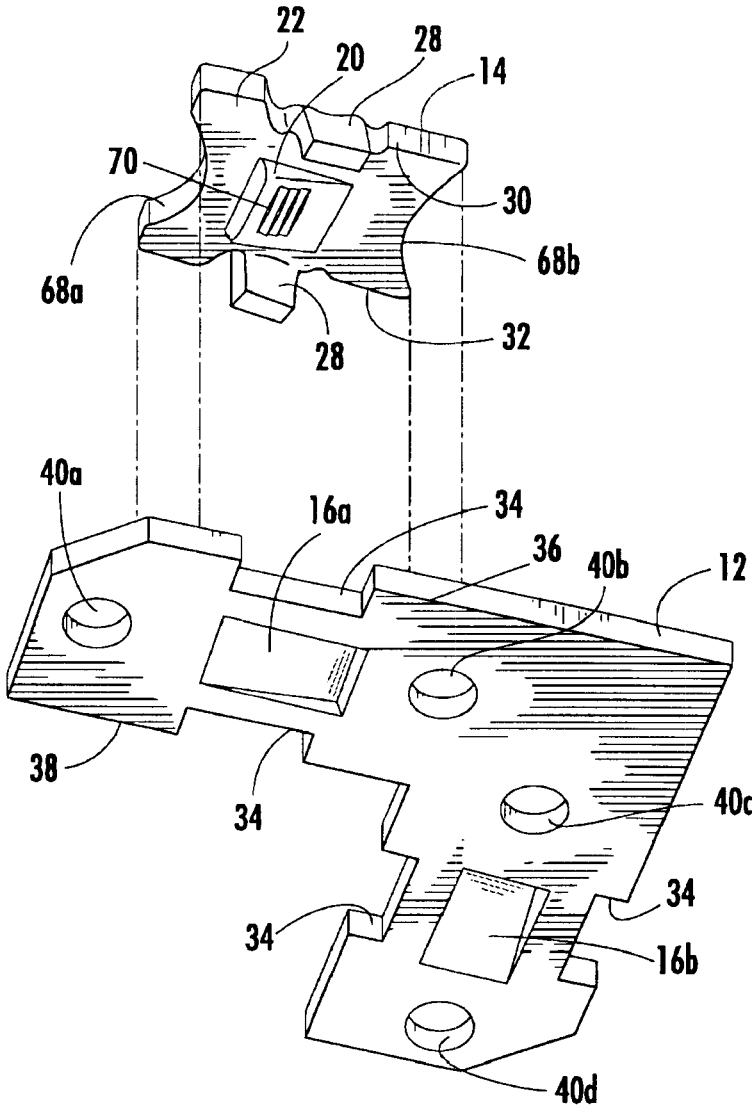
FIG. 2 is a bottom exploded perspective view of the picture frame joint of FIG. 1.

Referring first to FIGS. 1 and 2, top and bottom perspective views of the picture frame joint 10 of the present invention is shown to include a base plate 12 and a wedge plate 14 slidably connected thereto. The base plate 12 includes base ramps 16*a* and 16*b* emanating upwardly from the top surface 18 of the base plate 12 where base ramps 16*a* and 16*b* decrease in height running toward the free ends 12*a* and 12*b* of the base plate 12 as shown in FIGS. 1 and 2. The wedge plate 14 includes a wedge ramp 20 on its bottom surface 22 that increases in height running from right to left as shown in FIG. 2. The wedge ramp 20 is positioned to run in an direction opposite to the direction of base ramp 16*a* on the top surface 18 of the base plate 12. As will be discussed in detail below, the wedge ramp 20 and the base ramps 16*a* and 16*b* engage in complementary fashion to secure members 24 and 26, as in FIGS. 4 and 7, of a picture frame assembly together.

To connect two picture frame parts 24 and 26 together, a single picture frame joint 10 of the present invention is employed. For example, it is desirable to connect two picture frame members 24 and 26 together at a ninety degree angle relative to one another to form a corner of a picture frame. The corners are typically mitered at a complementary 45 degree angle to form a neat corner. As shown in the figures, the base plate 12 is preferably formed in an L-shape with two base ramps 16*a* and 16*b* provided at opposing ends thereof. In should be understood that a first base ramp 16*a* engages with one separate wedge ramp 20 to connect the joint to a first picture frame member 24 and a second base ramp 16*b* on the base plate 12 engages with a second separate wedge ramp (not shown) to connect the joint 10 to a second picture frame member 26 thereby effectively mating the first picture frame member 24 to the second picture frame member 26.

The use of an L-shaped base plate 12 is one of many configurations that can be employed in accordance with the present invention and is preferred because it is well-suited to connect two picture frame members 24 and 26 together at a ninety degree angle relative to one another. In an alternative embodiment, which is not shown, the base plate 12 may be linear in configuration with a pair of base ramps 16*a* and 16*b* at opposing ends thereof. For ease and simplicity of illustration and discussion, the connection of the picture frame joint 10 will be described below in detail for the connection of one side of the picture frame joint 10 of the present invention to one channel type picture frame member 24. The connection of a second picture frame member 26 is identical to the connection of the first picture frame member 24 to the first side of the picture frame joint 10.

Figure 5:
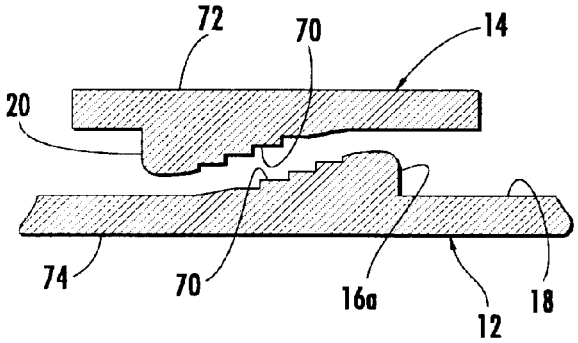
FIG. 5 is a cross sectional view through the line 5—5 of FIG. 4 showing communication of the stepped surface of the base plate with the ramped stepped surface of the wedge member.

As best seen in FIG. 5, the wedge plate 14 is positioned so that the wedge ramp 20 loosely communicates with the corresponding base ramp 16*a* emanating upwardly from the top surface 18 of the base plate 12. To complete the joint, a second wedge plate (not shown) is also placed above the second base ramp 16*b* on the base plate 12.

In FIGS. 1 and 2, the wedge plate 14 further includes a pair of guide tabs 28 which emanate downwardly from front edge 30 and rear edge 32. Also, a notches 34 are formed in the front edge 36 and rear edge 38 of the base plate 12. When the wedge plate 14 is placed into communication with the corresponding ramp 16*a* on the base plate 12 the guide tabs 28 of the wedge plate 14 slidably reside within their corresponding notches 34 in the base plate 12. As a result, sliding travel of the wedge plate 14 along the length of the base plate 12 is limited to the length of the notches 34. As will be explained in detail below, leverage apertures 40*a*, 40*b*, 40*c* and 40*d* are provided through the base plate 12 on opposing sides of each of the ramps 16*a* and 16*b* on the top surface 18 of the base plate 12.

Figure 3:
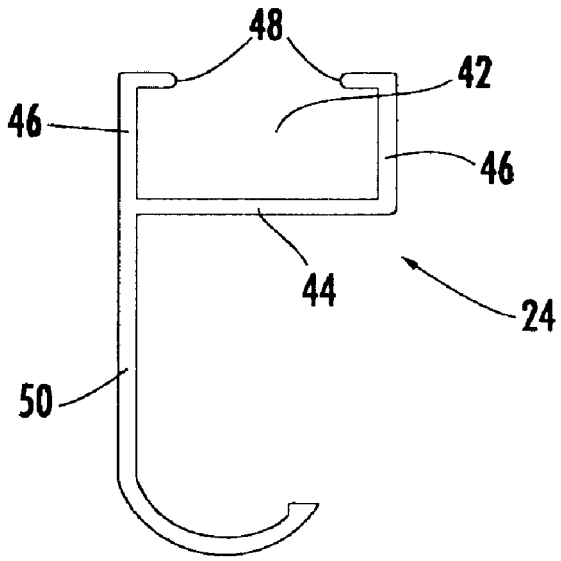
FIG. 3 is an end view of a picture frame member which is partially broken away for illustration purposes.

Turning now to FIG. 3, an end view of a typical picture frame member 24 of the "channel" type is shown to include a longitudinally running channel 42 defined by a floor 44 with opposing upstanding walls 46 with lips 48 extending inwardly from the respective free ends of the upstanding walls 46. Extending downwardly from the floor is an elongated flange member 50 for embracing a picture and other associated materials (not shown), such as glass and cardboard for the construction of an entire picture frame. Further details of the construction of this picture frame member 24 need not be discussed as they are well known in the art.

Figure 4:
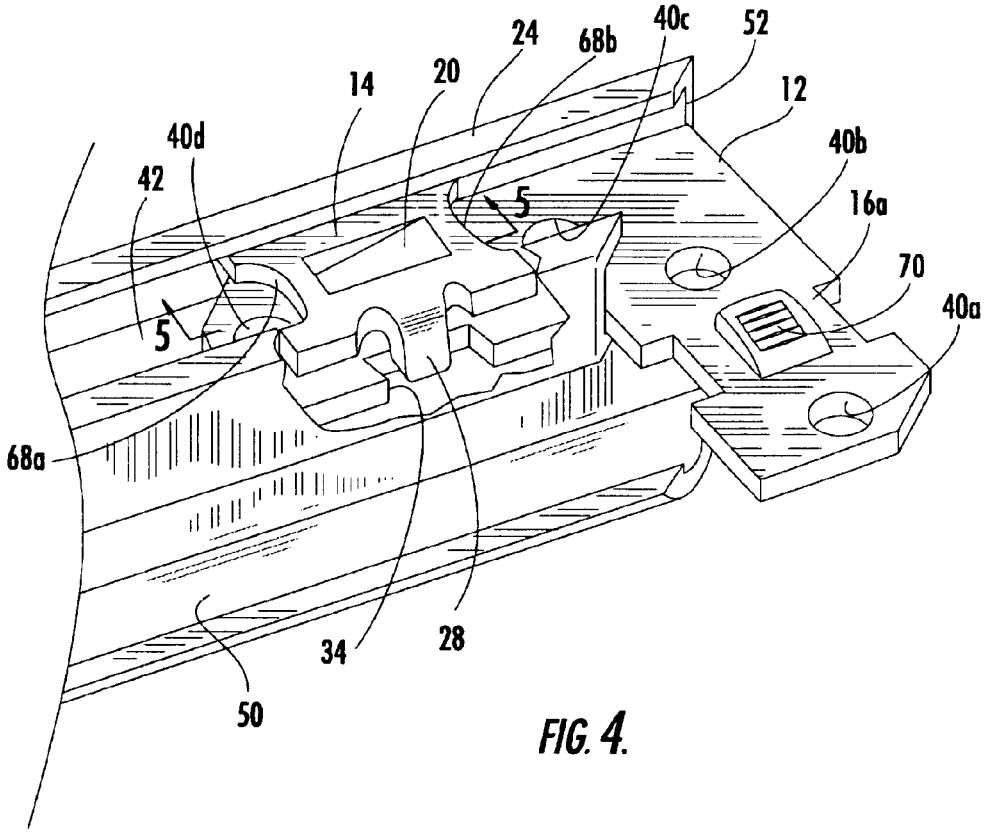
FIG. 4 is a perspective view of the picture frame joint of the present invention installed into the picture frame member of FIG. 3.

In accordance with the present invention, the picture frame joint 10 is employed to connect two picture frame members 24 and 26, such as of the type shown in FIG. 3, together to form a complete picture frame assembly. Referring to FIGS. 4–7 the installation of the picture frame joint 10 of the present invention is installed to a channel type picture frame member 24. First, as shown in FIG. 4, the wedge plate 14 is loosed mated to one leg of the L-shaped base plate 12 so that the guide tabs 28 of the wedge member 14 slidably reside within the notches 34 in the base plate 12. FIG. 5 illustrates the loose communication of the base plate 12 with the wedge plate 14 prior to insertion of one leg of the base plate 12 into the channel 42 of the picture frame member 24.

Figure 8A:
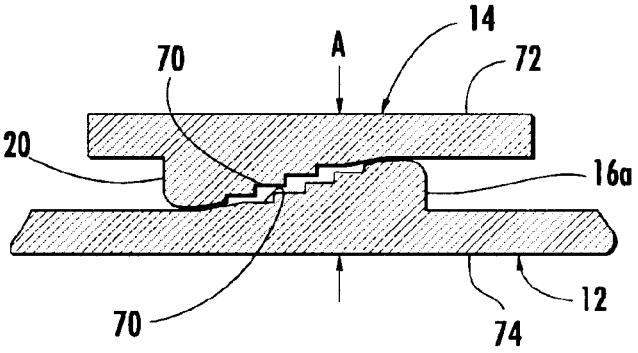
FIG. 8A is a cross-sectional view of the base plate and wedge member when the picture frame joint is in an unlocked condition as shown in FIGS. 4 and 6.

The coupled base plate 12 and wedge plate 14 are then inserted into the channel 42 of the picture frame member 24 via an open free end 52 of the picture frame member 24. In the preferred embodiment, the free end 52 of the picture frame member 24 is mitered at a 45 degree angle which is typical in channel type picture frame assemblies. In the condition show in FIG. 4, the base plate 12 may easily slide within the channel 42 of the picture frame member 24 with wedge plate 12 loosely secured thereto via the guide tabs 28 and notches 34 of the base plate 12. The floor 44 and inwardly turned lips 48 of the picture frame member 24 are a distance apart from one another that is larger than the overall stack height A of the base plate 12 and wedge plate 14 together, as shown in FIG. 8A. However, the distance between the floor 44 and the lips 48 is not large enough to allow for the guide tabs 28 of the wedge plate 14 to ride out of their respective notches 34 to permit free sliding of the wedge member 14 within the channel 42. Therefore, once the wedge plate 14 is mated with the base plate 12 and inserted into the channel 42 of the picture frame member 24, it cannot be separated from the base plate 12 and subsequently lost.

Figure 9:
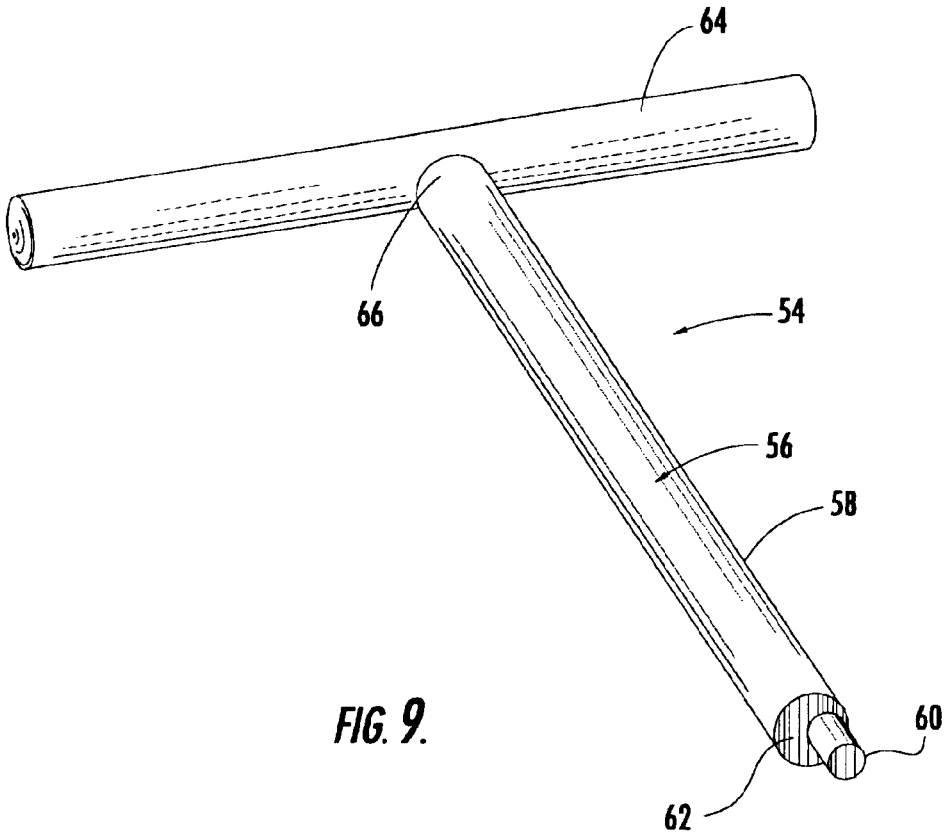
FIG. 9 is a perspective view of the installation tool used in accordance with the present invention.

Once the position of the coupled base plate 12 and wedge plate 14 within the channel 42 are adjusted as desired, they may be secured in place. In accordance with the present invention, the wedge plate 14 is moved so that the ramp 20 of the wedge plate 14 communicates with the ramp 16*a* of the base plate 12 so to increase the stack height of the base plate 12 and wedge plate 14 to frictionally secure the picture frame joint 10 between the floor 44 and lips 48 of the picture frame member 24. To assist in movement of the wedge plate 14, the tool 54 of FIG. 9 is employed. The tool 54 includes an elongated shaft 56 with an outer wall 58 that serves as a bearing surface. An eccentric pin 60 extends from the bottom free end 62 of the elongated shaft 56. A handle 64 is provided on the top free end 66 to facilitate rotation of the elongated shaft 56.

Figure 6:
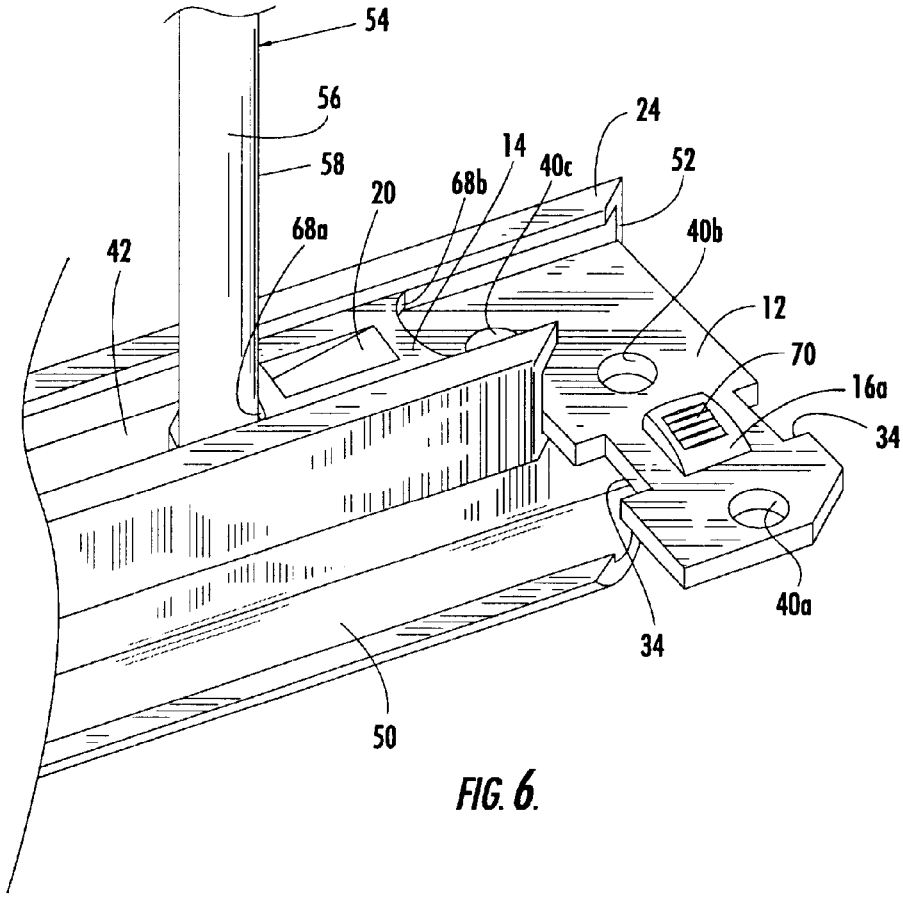
FIG. 6 is a perspective view showing insertion of the installation tool into the base plate for locking of the picture frame joint to the picture frame member.
Figure 7:
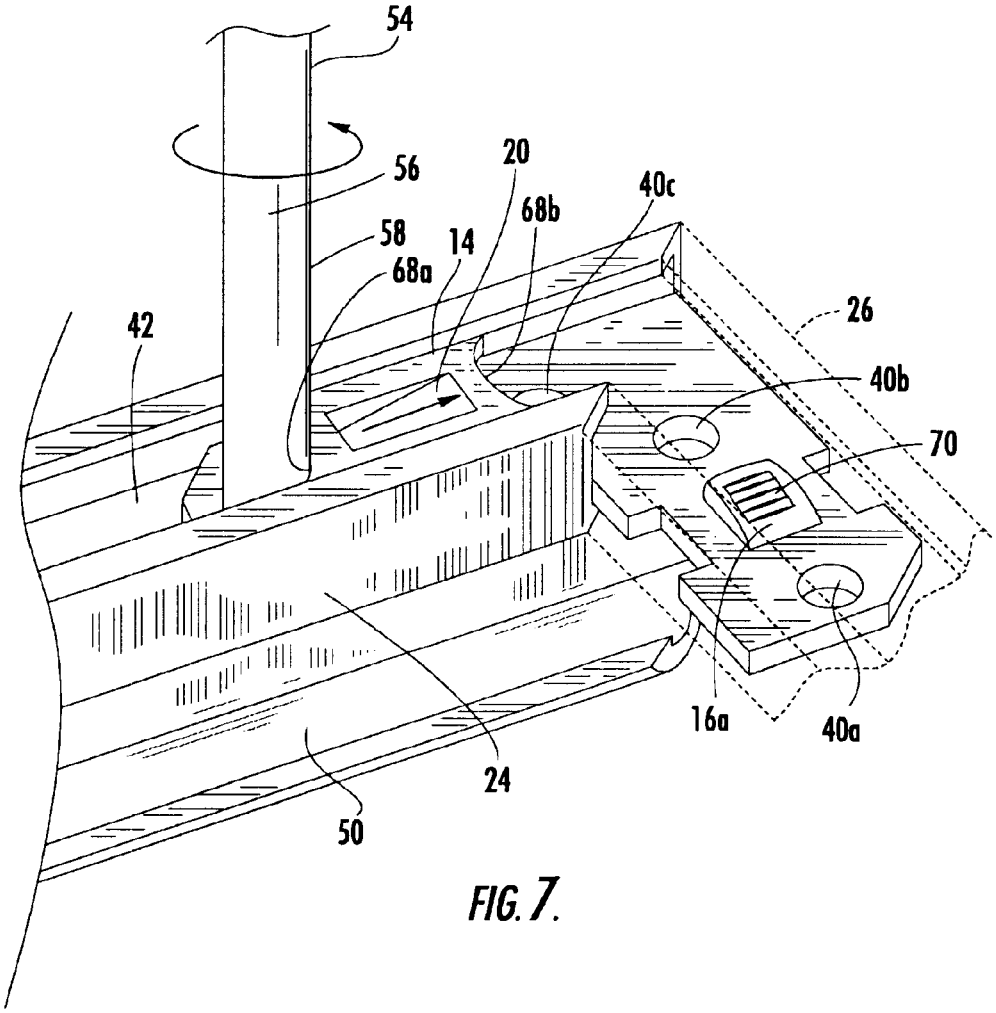
FIG. 7 is a perspective view showing the installation tool in the process of locking the picture frame joint to the picture frame member.
Figure 8B:
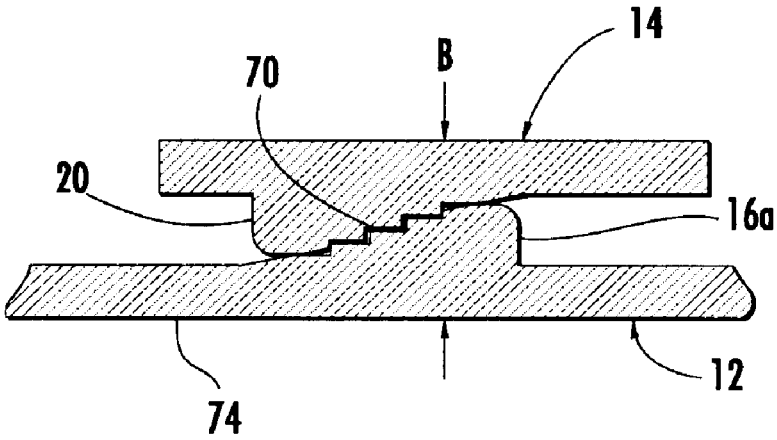
FIG. 8B is a cross-sectional view of the base plate and wedge member when the picture frame joint is in a locked condition as shown in FIG. 7.

Referring to FIG. 6, the pin 60 of the tool 54 is inserted into the aperture 40*d* that is closest to the wedge plate 14. Due to the eccentricity of the pin 60, the installation tool 54 must be oriented accordingly to allow the pin 60 to be fully inserted into the aperture 40*d* because the wedge plate and its bearing surface 68*a* is proximal thereto. As shown in FIG. 7, the tool 54 is rotated about the longitudinal axis through the eccentric pin 60 to cause the outer wall 58 of the elongated shaft 56 to bear onto the bearing surface 68*a* of the wedge plate 14 to urge it to the right. The movement of the wedge plate 14 to the right causes the ramp 20 of the wedge plate 14 to climb up the ramp 16*b* of the base plate 12 in ratcheting fashion to provide a greater overall stack height B, as shown in FIG. 8B which is greater than the stack height A shown in FIG. 8A. Such ratcheting is facilitated by the use of complementary steps 70 on both the ramps 16*a* and 16*b* on the base plate 12 and the ramp 20 on the wedge plate 14.

The increase of the stack height from A to B occurs within the confines of the picture frame member 24, namely between its floor 44 and inwardly turned lips 48. Therefore, such increase in stack height causes the top surface 72 of the wedge plate 14 to bear against the lips 48 of the picture frame member 24 and the bottom surface 74 of the base plate 12 against the floor 44 of the picture frame member 24. Essentially, the picture frame joint 10 of the present invention provides a unique expanding internal clamp that is ideally suited for connecting to a channel type picture frame member 24 and securing one picture frame member 24 to another picture frame member 26.

Once the picture frame joint 10 is secured to the picture frame member 24, a second picture frame member 26, shown in broken lines in FIG. 7, may now be connected to the free end of the L-shaped base plate 12 to form the second half of the ninety degree picture frame structure. The second picture frame member 26 also includes a mitered 45 angle free end to mate cleanly with the 45 degree angle free end of the first picture frame member 24. The second picture frame member 26 is secured and locked to the base plate 12 in identical fashion as the first picture frame member 24 by use of a second wedge plate (not shown) to engage with the second ramp 16*a* on the top surface 18 of the base plate 12. With both sides of the base plate 12 connected to a picture frame member 24 and 26 respectively, the corner of the picture frame structure is fully assembled. A total of four picture frame joints 10 and four picture frame members are employed to construct a completed picture frame assembly.

To unlock the picture frame joint 10 from the picture frame members 24 and 26, the pin 60 of the installation tool 54 is inserted into the aperture 40*c* which is closest to the wedge plate 14 and, namely, its bearing surface 68*b*. Since the wedge plate 14 was shifted to the right for locking, the closest aperture is now the aperture 40*c* immediately to the right of the ramp 16*b*. The tool 54 is rotated with the pin 60 in the aperture 40*c* to cause the outer wall 58 of the elongated shaft 56 to bear against the bearing surface 68*b* on the wedge plate 14 to urge the wedge plate 14 to the left out of frictional engagement with the lips 48 of the picture frame member 24 and into an unlocked condition. When unlocked, the wedge plate 14 still remains loosely mated with the base plate 12 due to the continued positioning of the guide tabs 28 within the notches 34 of the base plate 12, as in FIG. 4. Loss of the wedge plate 14 is thereby avoided during unlocking of the picture frame joint 10. The picture frame members may now be separated to facilitate changing of the picture or glass (not shown) residing therein.

The picture frame joint 10 of the present invention may be manufactured in many different ways and of different materials. Preferably, the picture frame joint 10 is manufactured of steel for ease of manufacture and durability and may be anodized or otherwise chemically treated, if desired. Both the wedge plate 14 and base plate 12 are preferably die cut and stamped out of steel without the need for expensive thread tapping and custom set screws as required in prior art joint connectors for picture frames. Further, the picture frame joint 10 may be molded from other materials, such as plastic, to suit the application at hand.

Moreover, the construction of the picture frame joint itself 10 may be modified and still be within the scope of the present invention. For example, the ramps 16*a* and 16*b* on the base plate 12 preferably decrease in height running toward the respective free ends of the base plate 12. However, reversing of the direction of the ramps 16*a* and 16*b*, and the positioning of the wedge plates 14 thereon, is contemplated by the invention. While steps 70 are preferred to provide additional friction to the ramp 20 of the wedge plate and the ramps 16*a* and 16*b* base plate, other structures may be employed to add such friction. For example, the steps 70 on the surfaces of the ramps 16*a*, 16*b* and 20 may be replaced with a roughened surface or grit coating to provided the preferred friction interface. It is also possible that the steps 70 or additional friction structure be eliminated entirely and still be within the scope of the present invention.

As stated above, the picture frame joint of the present invention may be construction in many different ways. In the preferred embodiment of the present invention, the wedge plate and the base plate are separated from each other. The guide tabs of the wedge plate ride within their respective notches to permit the free sliding of the wedge member within channel 42. This ensures that steps 70 on the wedge plate 14 are aligned with the complementary and corresponding steps on the base plate. However, it is possible for the guide tabs to eject out of their corresponding notches which can result in the wedge plate being separated from the base plate. Since the wedge plate and base plate are separate members, it is required that they be manually held together for installation, namely, during insertion into the channel of the picture frame. As a result, it is possible for the wedge plate to be misaligned with the base plate causing an unsatisfactory installation.

The use of apertures 40*a–d* and the tool 54 with eccentric pin 60 are preferably employed in accordance with the present invention. However, other structures may be employed as long as they facilitate the engagement and disengagement the wedge plate 14 to and from the base plate.

As shown in FIGS. 10–14, an picture frame joint 100 of the alternative embodiment is shown where the wedge plates 102*a* and 102*b* and base plate 104 are permanently connected to one another. This structure obviates the need for guides tabs 28 on wedge member 14 and notches 34 in the base member 12 shown in the preferred embodiment of FIG. 1. The connected wedge plate 102*a* to one end of the base plate 104 and wedge plate 102*b* to the other end of the base plate 104 in the embodiment of FIGS. 10–14 ensures that the mating contact surfaces or ramps 106*a* and 106*b* of the wedge plates 102*a* and 102*b* are precisely aligned with the corresponding and respective ramps 108*a* and 108*b* during installation. For ease of illustration, FIGS. 10–14 are shown apart from a picture frame. It should be understood that this alternative embodiment is installed into the channel of a picture frame in the same general fashion as the preferred embodiment 10 as shown, for example, in FIGS. 4, 6 and 7.

Figure 10:
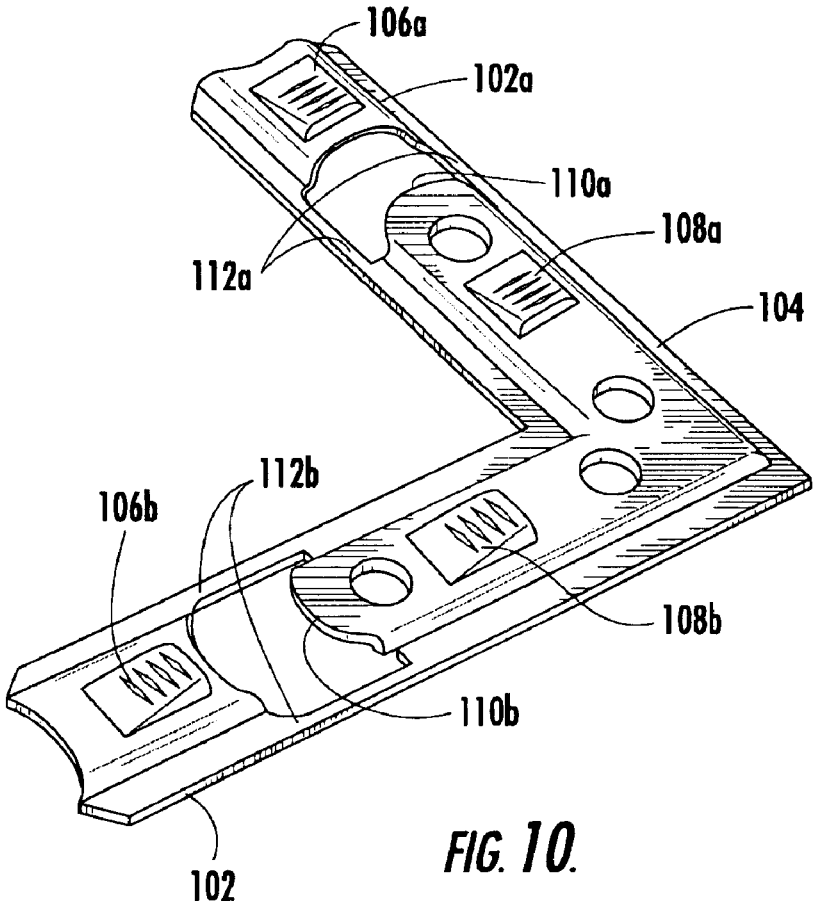
FIG. 10 is a perspective view of an alternative embodiment of the picture frame joint of the present invention in a stamped, unfinished condition.
Figure 14:
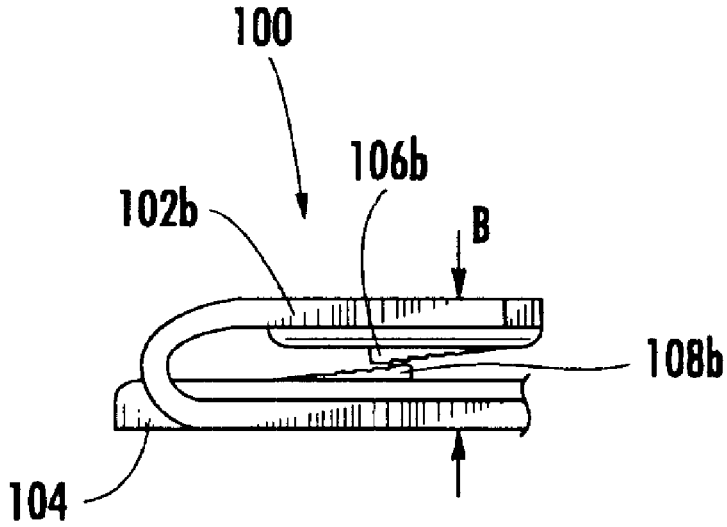
FIG. 14 is a side elevational view of the picture frame joint of FIG. 13.

Referring specifically to FIG. 10, a perspective view the picture frame joint 100 of the alternative embodiment is shown in its stamped but unfinished condition. The picture frame joint 100 of FIG. 10 is formed into a unitary member by progressive tooling with the desired apertures and stepped structures. In similar fashion to the preferred embodiment 10 of the present invention, a preferably L-shaped base plate 104 is provided with free ends 110*a* and 110*b*. Two wedge plates 102*a* and 102*b* are respectively connected to the free ends 110*a* and 110*b* of the base plate 104. The wedge plates 102*a* and 102*b* each include a ramp 106*a* and 106*b*, which is preferably stepped, for mating with a corresponding ramp 108*a* and 108*b* structure on the base plate 104 which is also preferably stepped. The communication of two stepped surfaces (for example, ramps 106*b* and 108*b*) is shown in FIG. 14. It is also possible to employ a ridged or roughened surface on ramps 106*a*, 106*b*, 108*a* and 108*b* instead of stepped surface.

The wedge plates 102*a* and 102*b* are connected to respective ends 110*a* and 110*b* of the base plate 104. A pair of connectors 112*a* and 112*b* are preferably employed to connect each of the wedge plates 102*a* and 102*b* to their respective free ends 110*a* and 110*b* of the base plate 104. As will be discussed in detail below, the connectors 112*a* and 112*b* are folded to create hinges between the wedge plates 102*a*, 102*b* and the base plate 104. It should be noted that while a pair of connectors 112*a*, 112*b* are preferred, a single connector (not shown) or more than two connectors may be used to form hinges depending on the size and configuration of the picture frame connector at hand. Any type of connector can be used as long as the wedge plates 102*a* and 102*b* are connected to the base plate 104.

Figure 11:
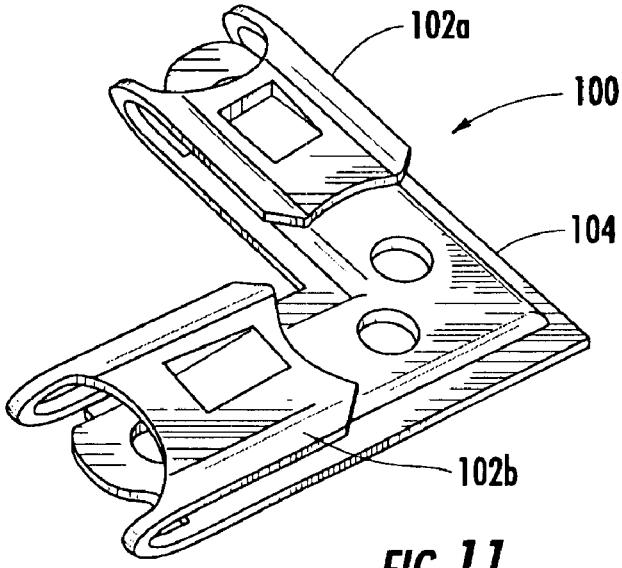
FIG. 11 is a perspective view of the alternative embodiment of the picture frame joint of the present invention in finished condition in preparation for installation into a picture frame.
Figure 12:
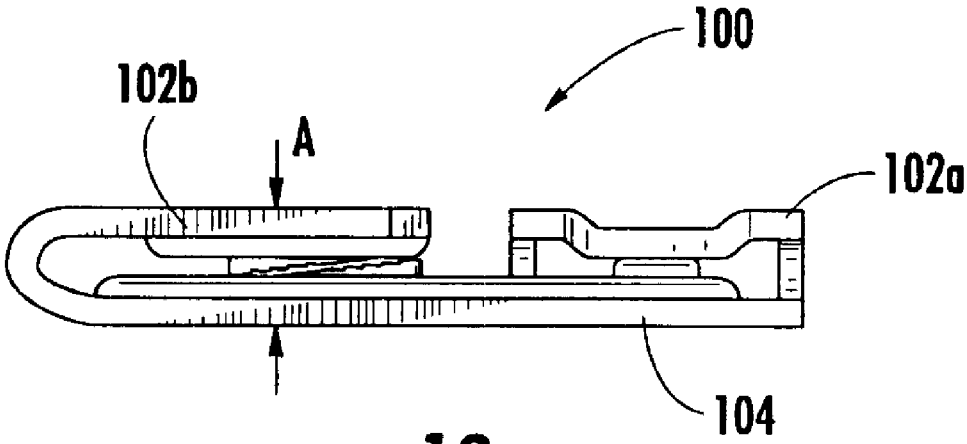
FIG. 12 is a front elevational view of the picture frame joint of FIG. 11.

Turning now to FIGS. 11 and 12, the picture frame joint 100 of the alternative embodiment, in a finished condition ready for installation, is shown. FIG. 11 shows a perspective view of the finished picture frame joint 100 while FIG. 12 shows a front elevational view. The wedge members 102*a* and 102*b*, as seen in FIG. 10, are folded over so that the respective ramped stepped surfaces 106*a*, 106*b* and 108*a*, 108*b* are in alignment with each other. In this initial condition, the surfaces 106*a*, 106*b* and 108*a*, 108*b* are not in communication with each other. As a result, the overall initial thickness of the picture frame joint, shown as A, is similar to the initial thickness A shown in FIG. 8A for the preferred embodiment 10 of the present invention.

In similar fashion to the preferred embodiment, in the alternative embodiment 100, the ends 110*a* and 110*b* of the base plate 104, with a wedge plate 102*a* and 102*b* positioned thereon, is inserted into the channel 42 of a picture frame 24 in similar fashion to the positioning of the preferred embodiment 10 shown in FIG. 4. The thickness A is less than the height of the channel 42 to permit an end of the base plate 104 with a wedge plate 102*a*, 102*b* thereon to easily slide therein.

Figure 13:
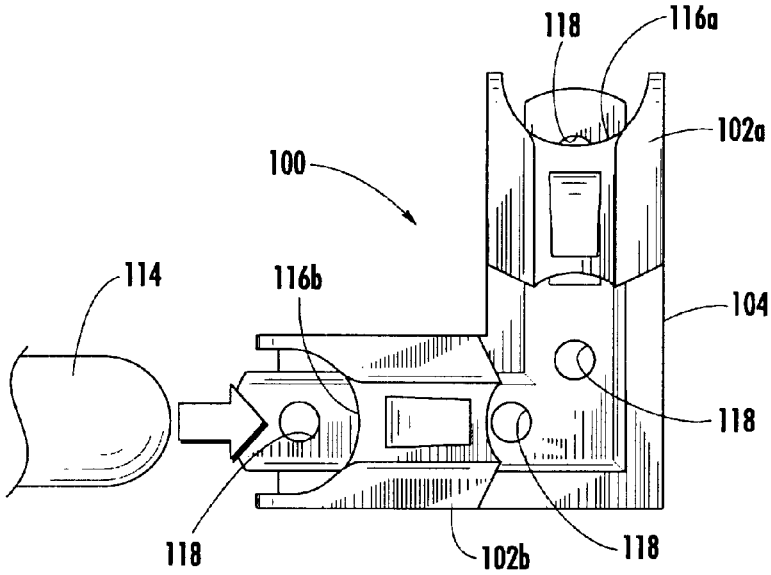
FIG. 13 is a top view of the picture frame joint of FIG. 11 after receiving the impact of an anvil during the installation process.

With a end of the base plate 104 positioned within the channel 42 of the picture frame 24, as seen in FIG. 3, the picture frame joint 100 can be secured in place. In similar fashion to locking of the picture frame joint 10 of the preferred embodiment of the present invention, as shown in FIG. 6, the picture frame joint 100 of the alternative embodiment is secure in place by forming an internal clamp within the channel 42 of the picture frame 24. More specifically, as shown in FIG. 13, the wedge member, for example, wedge member 102*b* is urged in a direction so that the stepped surface 106*b* of the wedge member 102*b* engages with the stepped surface 108*b* of the base plate 104 thereby increasing the thickness of the joint to thickness B which is shown in FIG. 14. Wedge plate 102*a* is installed in the same fashion.

A wedge plate 102*a*, 102*b* can be urged or slid over the base plate 104 in a number of different ways. For example, as shown in FIG. 13, an powered anvil 114 may be used to forcibly impact an edge portion 116*a* of the wedge plate 102*b* to urge the wedge plate 102*b* in the desired direction. It is possible to provide two powered anvils to simultaneously and automatically contact surfaces 116*a* and 116 to respectively urge both the two wedge plates 102*a* and 102*b* connected to opposing ends 110*a* and 110*b* of the base plate 104 to form a complete picture frame joint in a single operation. Alternatively, the eccentric tool 54 of FIG. 9 may be employed to manually urge a wedge member 102*a* and 102*b* in the desired direction by cam action via engagement of the pin 60 of with the apertures 118 in the base plate. The appropriate aperture is employed, as discussed above, to urge a wedge plate 102*a*, 102*b* in the desired direction.

In contrast to the preferred embodiment 10 of the picture frame joint of the present invention, the alternative embodiment 100 of the picture frame joint includes a flexible hinge created by connectors 112*a* and 112*b* that connects the wedge members 102*a*, 102*b* to the base member 104. As a wedge member 102*a*, 102*b* is urged in a direction, the connectors 112*a*, 112*b* hingedly flex to permit movement as desired. The connectors 112*a*, 112*b*, as is the remainder of the picture frame joint, preferably made of metallic material, such as steel and are preferably integrally made from the same stamping as the wedge members 102*a*, 102*b* and base plate 104. The thickness and dimensions of the connectors 112*a*, 112*b* is selected to permit them to give and flex during movement of the wedges 102*a*, 102*b* due to the forces of the anvil 114 or tool 54 yet is still enough to maintain the wedge plates 102*a*, 102*b* in place prior to installation as in FIG. 11 or after full installation within a channel 42 of a picture frame 24.

Further, the picture frame joint 100 of FIGS. 10–14 has a further advantage of being of a profile that enables the overall assembly 100 to be much lighter than prior art assemblies. A reduced, ribbed profile enables the overall thicknesses A and B to stay the same while reducing the overall amount of material employed. The reduces weight profile is shown, for example, in FIG. 12. As a result, the total weight of the assembly 100 is reduced thereby reducing shipping costs of the picture frame joint. The assembly is, particularly, much lighter in weight than known prior art corner joints that employ mating plates with screws and tapped apertures. Also, as with the picture frame joint 10 of the preferred embodiment of the present invention, the picture frame joint 100 of the alternative embodiment is preferably made of metal, such as steel, but could be made of other material.

It would be appreciated by those skilled in the art that various changes and modifications can be made to the illustrated embodiments without departing from the spirit of the present invention. All such modifications and changes are intended to be covered by the appended claims.

What is claimed is:

1. A joint assembly, comprising:

a base member having a contact surface, the contact surface having a first frictional position-holding means;

a wedge member having a contact surface substantially complementary to the contact surface of the base member and being connected to the base member, the contact surface of the wedge member having a second frictional position-holding means, wherein the first position-holding means and the second position-holding means are substantially complementary; an assembly thickness being defined by the wedge member positioned on the base member;

a malleable connector connecting the wedge member to the base member;

whereby sliding of the wedge member along the base member, with the contact surface of the wedge member in communication with the contact surface of the base member, increases the assembly thickness, and the first position-holding means interacts with the second position-holding means to retain the wedge member in position on the base member.

2. The joint assembly of claim 1, wherein the base member and wedge member are manufactured of metal.

3. The joint assembly of claim 1, wherein the contact surface of the base member and the contact surface of the wedge member are stepped, the stepped contact surfaces comprising the first and second frictional position-holding means, respectively.

4. The joint assembly of claim 1, wherein the malleable connector is a living hinge.

5. The joint assembly of claim 1, wherein the base member is L-shaped having a first leg and a second leg with a first contact surface on the first leg and a second contact surface on the second leg; the first leg and first contact surface being capable of communication with a first wedge member and the second leg and second contact surface being capable of communication with a second wedge member.

6. A structural joint, comprising:

a frame member having a floor and a top bearing surface defining a channel therebetween;

a base member slidably residing in the channel; the base member having a first contact surface, which first contact surface has thereon a first position-holding means;

a wedge member having a second contact surface substantially complementary to the first contact surface and being connected to the base member, the second contact surface having thereon a second position-holding means that is complementary to the first position-holding mean; the wedge member residing between the contact surface of the base member and the top bearing surface of the frame member; a joint assembly thickness being defined by the wedge member positioned on the base member;

a malleable connector connecting the wedge member to the base member;

whereby sliding of the wedge member toward the contact surface of the base member internally clamps the base member to he frame member and the first position-holding means interacts with the second position-holding means to retain the wedge member in position on the base member.

7. The structural joint of claim 6, wherein the frame member is a picture frame molding.

8. The structural joint of claim 7, wherein the picture frame molding is manufactured of metal.

9. The structural joint of claim 7, wherein the picture frame molding is manufactured of wood.

10. The structural joint of claim 7, wherein the picture frame molding is manufactured of plastic.

11. The structural joint of claim 6, wherein the base member and wedge member are manufactured of metal.

12. The structural joint of claim 6, wherein the contact surface of the base member and the contact surface of the wedge member are stepped, the stepped contact surfaces comprising the first and second position-holding means, respectively.

13. The structural joint of claim 6, further comprising;

means for sliding the wedge member into communication with the base member and increasing the joint assembly thickness.

14. The structural joint of claim 6, further comprising:

means for sliding the wedge member out of communication with the base member and decreasing the joint assembly thickness.

15. The structural joint of claim 6, wherein the base member is L-shaped having a first leg and a second leg with a first contact surface on the first leg and a second contact surface on the second leg; the first leg and first contact surface being capable of communication with first wedge member for connection to a first frame member and the second leg and second contact surface being capable of communication with a second wedge member for connection of a second frame member thereby securing the first frame member relative to the second member.

16. The structural joint of claim 6, wherein the malleable connector is a living hinge.

17. A method of assembling a structural joint, comprising the steps of:

providing a frame member having a floor and a top bearing surface defining a channel therebetween;

providing a connection member having first contact surface extending upward in a first direction having a high portion and a low portion, the first contact surface having thereon a first position-holding means;

providing a wedge member having a second contact surface substantially complementary to the first contact surface, the second contact surface having thereon a second position-holding means;

connecting the wedge member to the connection member with a malleable connector;

mating the wedge member with the connection member with the first contact surface in communication with the second contact surface;

inserting the connection member and edge member into the channel of the frame member;

urging the wedge member to further ride the second contact surface up onto the first contact surface of the connection member; and engaging the first position-holding means with the second position-holding means, thereby internally clamping the connection member and the wedge member between the floor of the frame member and the top bearing surface, the first and second position-holding means preventing the wedge member from moving relative to the connection member.

18. The method of claim 17, wherein the malleable connector is a living hinge.

* * * * *